US006195020B1

(12) United States Patent
Brodeur, Sr. et al.

(10) Patent No.: US 6,195,020 B1
(45) Date of Patent: Feb. 27, 2001

(54) VEHICLE PRESENCE DETECTION SYSTEM

(75) Inventors: Ronald E. Brodeur, Sr., Waterbury, CT (US); Clifford J. Bader, West Chester, PA (US); Charles S. DeRenzi, Exton, PA (US); Eugene Mullin, Phoenixville, PA (US)

(73) Assignee: 3461513 Canada Inc., Kirkland (CA)

( * ) Notice: Subject to any disclaimer, the term of this patent is extended or adjusted under 35 U.S.C. 154(b) by 0 days.

(21) Appl. No.: 09/369,713

(22) Filed: Aug. 6, 1999

Related U.S. Application Data

(60) Provisional application No. 60/095,715, filed on Aug. 7, 1998.

(51) Int. Cl.[7] ..... G08G 1/01

(52) U.S. Cl. ..... 340/933; 340/933; 246/125; 246/126

(58) Field of Search ..... 340/933, 932, 340/931; 246/125, 126, 127, 293, 292

(56) References Cited

U.S. PATENT DOCUMENTS 4,703,303 * 10/1987 Snee ..... 340/47
5,735,492 * 4/1998 Pace ..... 340/941
5,864,304 * 1/1999 Gerszberg et al. ..... 340/903
5,954,299 * 9/1999 Pace ..... 246/293

* cited by examiner

*Primary Examiner*—Jeffery A. Hofsass
*Assistant Examiner*—Daniel Previl
(74) *Attorney, Agent, or Firm*—Swabey Ogilvy Renault

(57) ABSTRACT

A system and method which can detect the presence of a vehicle within the protected area of a four gate railroad crossing, determine its location and direction it is moving in, and open an appropriate exit gate to allow the vehicle to escape prior to the arrival of a train at the crossing. The system has a series of magnetometer sensors suitably placed in the crossing to detect the presence of a vehicle. The sensors are connected to a controller which analyzes readings from the sensors. Upon the approach of a train, the controller, based on analysis of readings from the sensor, determines if a vehicle has become entrapped and determines which exit gate must be opened or should remain open to allow the entrapped vehicle to escape. The system also has self test capabilities as well as the ability to continuously update, when no vehicles are present, a baseline reading of the ambient magnetic condition of the crossing area, which baseline the controller uses in analyzing data from the sensors.

39 Claims, 8 Drawing Sheets

VEHICLE PRESENCE DETECTION SYSTEM

This application claims the benefit of U.S. Provisional No. 60/095,715 filed Aug. 7, 1999.

FIELD OF THE INVENTION

The present invention relates to railroad crossing safety and control devices. More particularly it relates to a system and method for preventing vehicles from becoming entrapped at a railroad crossing when a train is approaching the crossing.

BACKGROUND OF THE INVENTION

Railroad grade crossings have always posed a danger to vehicles using them. The size and momentum of a train as compared to vehicles which use the crossing, i.e. automobiles, buses and trucks, is so great that a direct collision between a train and a vehicle at a crossing such as an automobile or truck results in not only the total destruction of that vehicle but the death or serious injury of the occupants of the vehicle. The speed and momentum of a train approaching a grade crossing is such that there is little if any chance for the train to stop before reaching the crossing once the engineer of the train knows such a collision is imminent.

Building a viaduct over or under the rail line is generally prohibitive given the cost of construction and subsequent maintenance necessary to maintain it. Thus, the general methods of preventing accidents at a railroad grade crossing rely on providing systems which warn vehicles which use the crossing of the impending approach of a train and lower barriers or gates into place to restrict access to the crossing in the critical seconds before the train arrives at the crossing.

Two systems in wide use today are a standard track circuitry and vital relay network. Most rail lines are sectioned into large long blocks for control and monitoring purposes. The standard track circuitry is a common type of train presence detection circuitry used to detect the presence of a train within a block of track. The vital relay network is a series of relays used to control railroad crossing warning lights and the raising and lowering of primary protective crossing gates. The protective crossing gates generally being gates on the entrance lanes into a crossing. Both of these systems work in conjunction with each other and detect trains by means of electrical conductors across the rails as current flows through rail car wheels. A protected crossing located in the block, ideally at its center, has a vital relay network. Upon receipt of a signal from the standard track circuitry, that a train has entered the block and is approaching the crossing, the vital relay network activates the crossing warning lights and then lowers the crossing gates.

A two gate arrangement as depicted in FIG. 2A is a very common arrangement used to restrict access to a railroad crossing. However, the open exit lanes in the two gate arrangement present their own serious problems in that they allow impatient drivers access to the crossing even though the entrance lanes have barriers across them. Such easy circumvention of the safety barriers of a two gate crossing creates significant dangers in any situation and especially on a rail line that has frequent high speed trains using the line every day.

An alternative to the two gate system is the four gate arrangement as depicted in FIG. 2 which has two additional gates at the exit lanes to the crossing. However, the four gate systems have their own problems. For instance one common problem is the entrapment of a vehicle within the protected area of a four gate crossing because the gates are lowered prior to the vehicle being able to exit from the protected area of the crossing as a train is approaching. Once these vehicles become entrapped between the gates, there is little opportunity for them to escape and avoid being hit by an on coming train. A number of systems currently exist which attempt to deal with the problem of vehicle entrapment; however, these systems are expensive and difficult to install and maintain. A number of them rely on large loops which must be buried in the ground fairly close to the surface of the ground. Additionally, many of these systems lack the capability to respond to wide variety of conditions and circumstances.

Thus, what is need is an inexpensive and easy to install and maintain method and system which allows a vehicle to escape from a four gate protected crossing while retaining all of the advantages of the four gate grade crossing. A system that can also respond to and deal with a wide variety of different conditions and circumstances.

SUMMARY

It is an object of the present invention to provide a system which can detect a vehicle entrapped at a railroad grade crossing and allow it to escape prior to the entry of a train into the crossing. It is another object of the present invention to provide such a system which can adjust to changing conditions so it can continue to successfully serve its purpose.

It is yet another object of the present invention to provide such a system which is cost effective, durable and easily integrated into existing systems with little or no alteration of the current systems.

It is yet another object of the present invention to provide a system which works with and compliments current train warning and grade crossing safety systems.

These and other objects are accomplished by providing a system for determining if a protected area of a railroad crossing is clear of vehicles and providing for the safe escape of any vehicles which may become entrapped in the protected area of a crossing prior to the arrival of a train at the crossing. The system has a plurality of strategically placed sensors located within the protected area of a railroad crossing; a command and control or controller analyzer apparatus to which each of the sensors have a communicative link; and wherein upon receipt of a train approach signal the command and control apparatus periodically takes readings from the sensors, compares those readings with a baseline and generates an all clear signal when it determines no vehicles are present in the protected area of the crossing, and the all clear signal activates an exit gate lowering signal.

In another aspect of this system it has the ability to separately monitor activity on two separate vehicle traffic lanes which traverse the protected area of the crossing and the system can determine which lane or lanes are clear and generate a separate "all clear" signal for each of the lanes individually so that exit gates for only the lane or lanes for which the all clear signals are generated will be lowered.

In a further aspect of the system of this invention, the system continues to take readings from the sensors after generating the all clear signal but before the train arrives at the crossing and, upon obtaining readings form the sensors that a vehicle may be in the protected area during this period of time, ceases generation of the all clear signal which allows the exit gate to be raised until the system determines the vehicle has exited the protected area, whereupon it again generates the all clear signal.

To achieve the objects of this invention it also provides a method for detecting the presence of a vehicle in a protected area of a railroad crossing and providing for the vehicles timely escape from the protected area of the crossing prior to the arrival of a train at the crossing. The method having the following steps: receiving a signal of a train approaching the crossing; commencing sampling of readings from sensors located in the protected area of the crossing; analyzing the readings from the sensors to determine if and when the crossing is clear so that exit gates to the crossing can be lowered; generating an all clear signal when it is determined that the crossing is free of any vehicular traffic; and lowering into place crossing exit gates.

In a further aspect of the method of this invention, it separately analyzes readings from a plurality of sensors to determine which of two lanes for traffic over the crossing is clear, and then it generates a separate all clear signal for each lane of traffic so that an exit gate in the traffic lane, for which the all clear signal is generated, can be lowered.

In another aspect of the method of this invention, it also periodically samples readings from the sensors during periods that no vehicles are in the protected crossing area and uses the readings taken to establish and verify a baseline for use in the analyzing step in determining when a vehicle is in the protected area.

In yet another aspect of the method of this invention, it also can include the additional steps of generating the all clear signal when it is determined the protected area is again clear of vehicles; monitoring the crossing for the presence of the train in the crossing; determining when the last car of the train has left the crossing; taking readings from the sensors after the last car of the train has left the crossing while it is still clear of vehicles; generating a signal that the crossing is clear of the train; and resetting the system to await the approach of the next train.

BRIEF DESCRIPTION OF THE DRAWINGS

The invention will be better understood by an examination of the following description, together with the accompanying drawings, in which.

DETAILED DESCRIPTION OF THE PREFERRED EMBODIMENT

Figure 1:
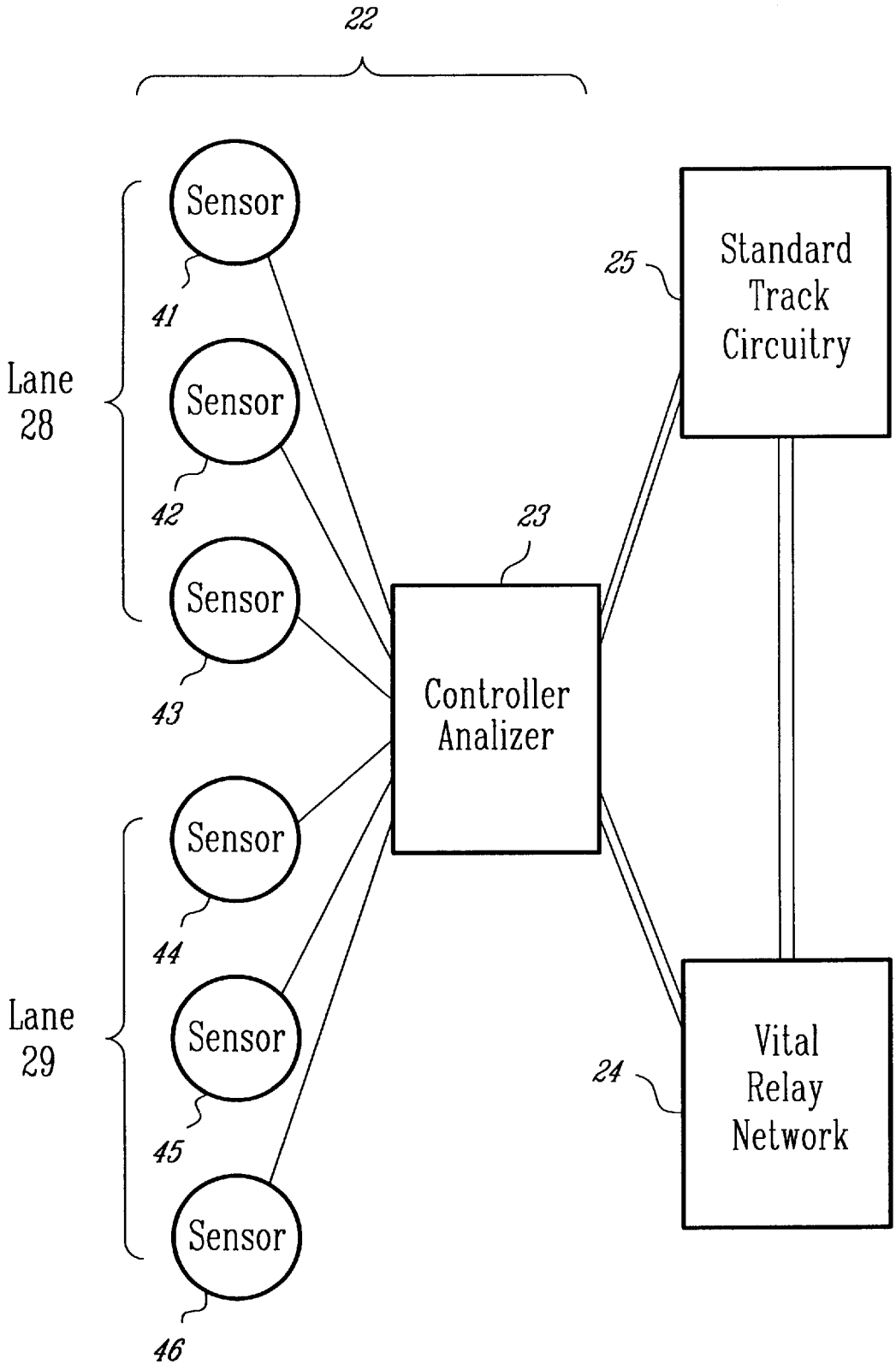
FIG. 1 is a schematic block diagram of the system of the present invention illustrating how it interfaces with current systems used to detect the presence of trains and control crossing warning and gate circuitry.

I. The Overall System:

FIG. 1 provides a schematic block diagram of the basic components of the system of the present invention and their relation to train presence and warning systems currently in use. The present invention consists of components 22, namely a controller analyzer 23 and various magnetic sensors 41 to 46 consisting of fluxgate magnetometers, in the preferred embodiment, which can detect both moving and stationary ferro-magnetic objects. The sensors 41 to 46 are strategically placed at a crossing and can sense the presence of objects, specifically vehicles, both stationary and moving. The controller analyzer 23 periodically and sequentially takes readings from each of the sensors and upon analysis determines if the sensor is picking up a reading from a vehicle.

The controller analyzer 23 connects to standard track circuitry 25 and a Vital Relay Network 24. The standard track circuitry 25 is a common type of train presence detection circuitry used to detect the presence of a train within a block of track and the vital relay network 24 is a series of relays used to control railroad crossing warning lights and the raising and lowering of crossing gates. Both of these systems work in conjunction with each other. Generally, railroad tracks are sectioned into large blocks for monitoring purposes and each block has its own standard track circuitry for detection of the presence of a train within the block. Generally, a protected crossing located in the block, ideally at its center, has a vital relay network 24, and upon receipt of a signal from the standard track circuitry 25 that a train has entered the block, the vital relay network 24 activates the crossing warning lights and the lowering of the crossing gates.

The standard track circuitry 25 and the vital relay network 24 are designed to work together such that when the standard track circuitry 25 initially detects the presence of a train, it signals the vital relay network 24, in sufficient time, that a train is approaching the crossing so that the vital relay network 24, can in a timely manner, turn on the lights and lowers the gates to clear the crossing. However, both of these systems which are currently in wide use are not "smart systems." They are designed based on the assumption that trains will always be traveling at no more than a certain maximum speed while in the block and that traffic moving into and across the protected area of the crossing island will have sufficient time to exit the island after the warning lights start flashing and before the gates close. However, this is not always the case. That is where the present invention comes into play.

As indicated in FIG. 1 the system 22 of the present invention is designed to work in conjunction with conventional standard track circuits 25 and vital relay networks 24. As will be discussed below in more detail, the system of the present invention 22 is designed to prevent the entrapment of vehicles between the gates of a crossing after they have been lowered. The system provides a magnetic sensor network 41 to 46 which monitors the protected area of a crossing. These sensors 41 to 46 connect to a controller analyzer 23 which takes periodically and sequentially, in the preferred embodiment, readings from the sensors and upon analysis of these readings determines if a vehicle is located within the protected area of a crossing.

Figure 2:
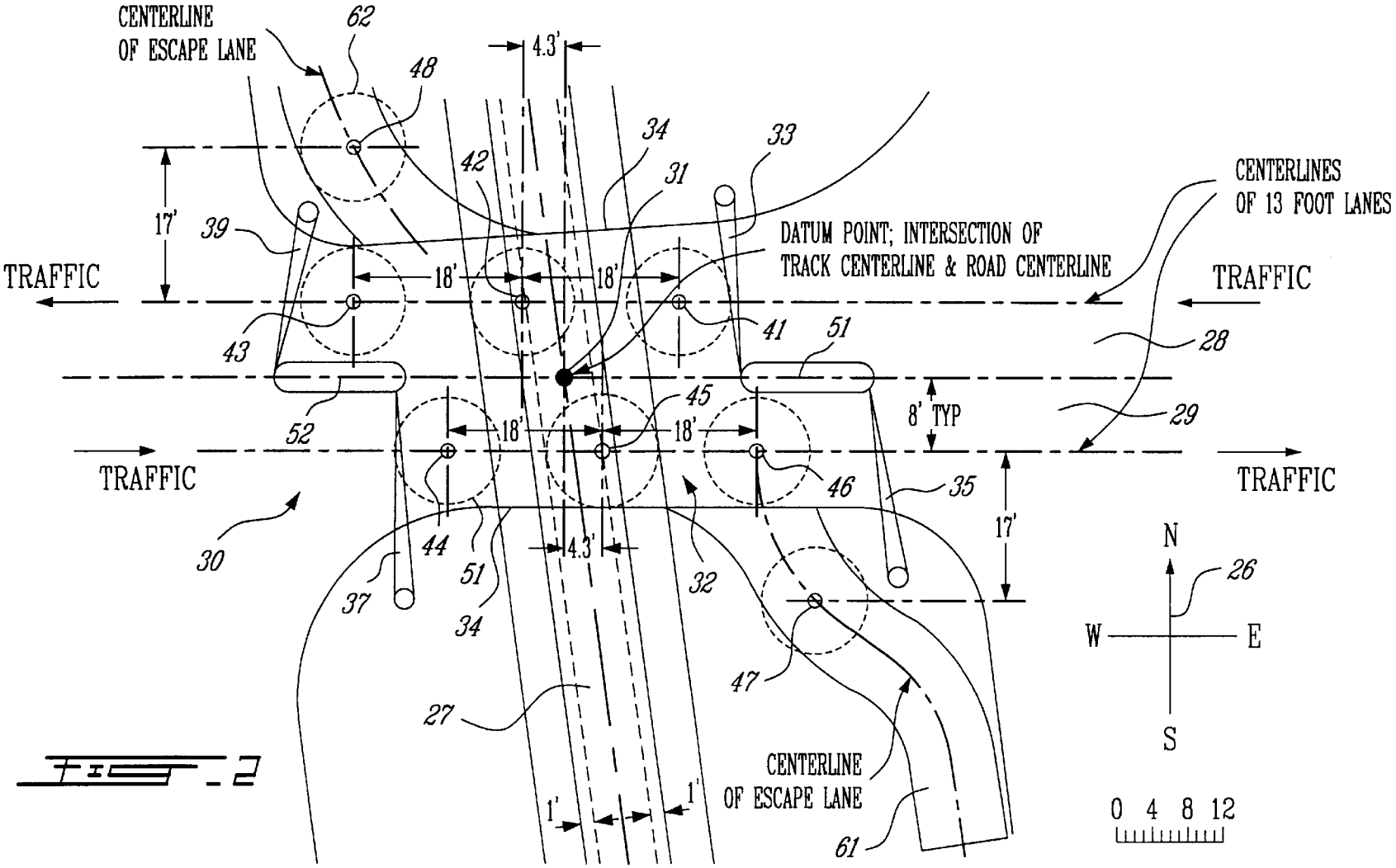
FIG. 2 is a diagram of a four gate railroad grade crossing showing, among other things, how the sensors of the present invention would be strategically positioned.
Figure 2A:
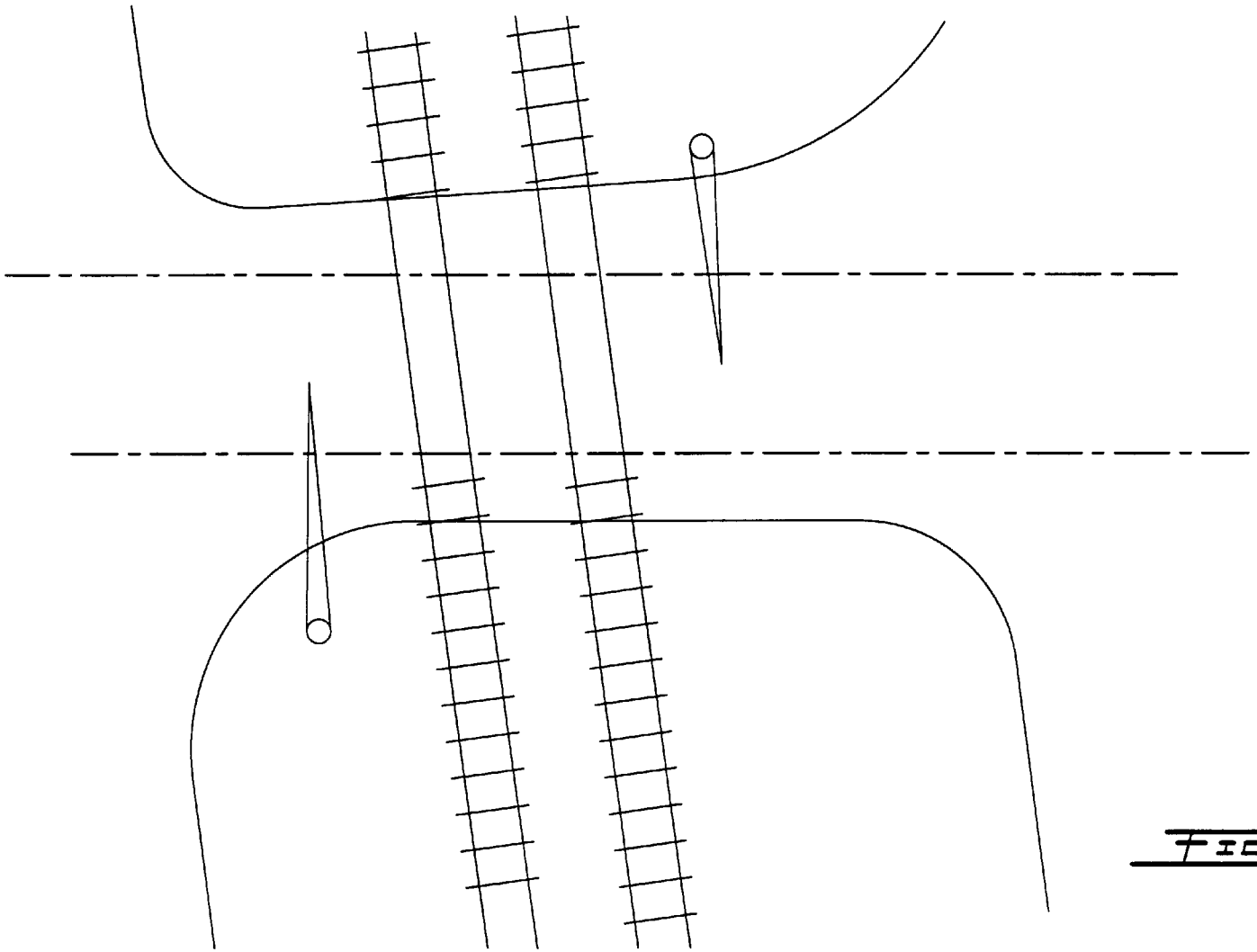

Upon the receipt of a signal from the standard track circuitry 25 that a train is approaching the crossing, the vital relay network 24 lowers vehicle entrance gates, 33 and 37 of FIG. 2, at the crossing. The controller analyzer 23, then begins to monitor the crossing through the sensors 41 to 46. If it determines that the crossing is clear of vehicles, based on its analysis of readings from the sensors, it generates an "all clear" signal, which upon receipt by the vital relay network 24 causes the vital relay network to lower exit gates, 35 and 39 of FIG. 2, at the crossing. The controller analyzer 23 continues to take readings from the sensors and upon determining that a vehicle may have entered the crossing prior to the arrival of the train at the crossing it removes the all clear signal which causes the vital relay network 24 to raise the exit gate of the lane for which the controller analyzer has detected the presence of a vehicle. In the preferred embodiment, the controller analyzer can monitor each lane for vehicle travel through the crossing and generate a separate all clear signal for each lane so that the vital relay network 24 only raises the exit gate of the lane in which a vehicle may have become entrapped.

The controller analyzer 23 has a baseline database to use in its analysis mode. This database consists of what the readings should be from each of the sensors when the protected area of the crossing is free of any vehicles. The controller analyzer 23 is designed to update the database periodically by an appropriate method such as summing, averaging, or a similar process. The controller analyzer 23 updates the database at a variety of different times during the night when little or no vehicle traffic is present to interfere with the readings. It also conducts a reading of the sensors for updating this database at the point the last car of a train has left the protected area of a crossing prior to the raising of the crossing gates.

The controller analyzer 23 can be a small programmable computer or a specially made dedicated hardware device consisting of electronic and logic circuits designed to carry out the functions of the system as described herein. After perusing this description one skilled in the art will have no problem in implementing it in either fashion.

II. The Set Up of the Crossing:

FIG. 2 depicts a railroad crossing 30 with generally typical features. The crossing typically has at least two lanes 28 and 29 traversing it for traffic through the crossing in opposite directions. Each of the lanes 28 and 29 each have three sensors or more if needed which are located within the protected area 32 of the crossing 30. The number of sensors and their placement depends on the coverage required. The protected area 32 generally is the area within the crossing 30 bounded by the crossing gates 33, 35, 37, and 39, and the extreme outside edges of lanes 28 and 29 located in the protected area. In FIG. 2 the curbing lines 34 on either side of the lanes 28 and 29 form a boundary.

Lane 28 for vehicle traffic in a westerly direction (note the compass points 26) has sensors 41, 42 and 43 positioned along its length. Lane 28 also has roadway or vehicle approach gate 33 at the side of the protected area 32 which vehicles in lane 28 would approach the crossing 30. Lane 28 has exit gate 39 located on the opposite side of the protected area 32. The sensors 41, 42 and 43 are evenly spaced out in lane 28 each being 18' (~5m) apart in the depicted embodiment. By strategically placing the sensors 41, 42 and 43 as depicted in FIG. 2 the system can maintain complete coverage of lane 28. Additionally, the strategic placement allows for localization of a vehicle to a specific area of lane 28 in the protected area.

Lane 29 for vehicle traffic in an easterly direction has sensors 44, 45 and 46 positioned along its length. Lane 29 also has roadway or vehicle approach gate 37 at the side of the protected area 32 which vehicles in lane 29 would approach the crossing 30. Lane 29 has exit gate 35 located on the opposite side of the protected area 32. The sensors 44, 45 and 46 are evenly spaced out in lane 29 each being 18' (~5 m) apart. By strategically placing the sensors 44, 45 and 46 as depicted in FIG. 2 the system can maintain complete coverage of lane 29. Additionally, the strategic placement allows for localization of a vehicle to a specific area of lane 29 in the protected area of the crossing.

As is typical in this type of crossing, a gap 51 exists between gates 33 and 35. Likewise a gap 52 exists between gate 37 and 39; however, only small vehicles can fit through gap 52. Not so typical in the crossing depicted in FIG. 2 are escape lanes 61 and 62. The escape lanes are an added failsafe type of feature available for vehicles to use as an alternative if they are entrapped by closure of the four quadrant gates 33, 35, 37 and 39 with a train approaching the crossing 30. If for some reason the exit gates do not reopen soon enough or a vehicle in front of the entrapped can not move out of the way then the entrapped vehicle can move into the escape lane to avoid being hit by the oncoming train. Two additional sensors are included 47 and 48 one in each of the escape lanes 61 and 62. Sensors 47 and 48 can connect to controller analyzer 23 and are used to monitor use of the escape lanes 61 and 62 either by vehicles which used the lanes to escape or if they are being used for some other activity.

Figure 3:
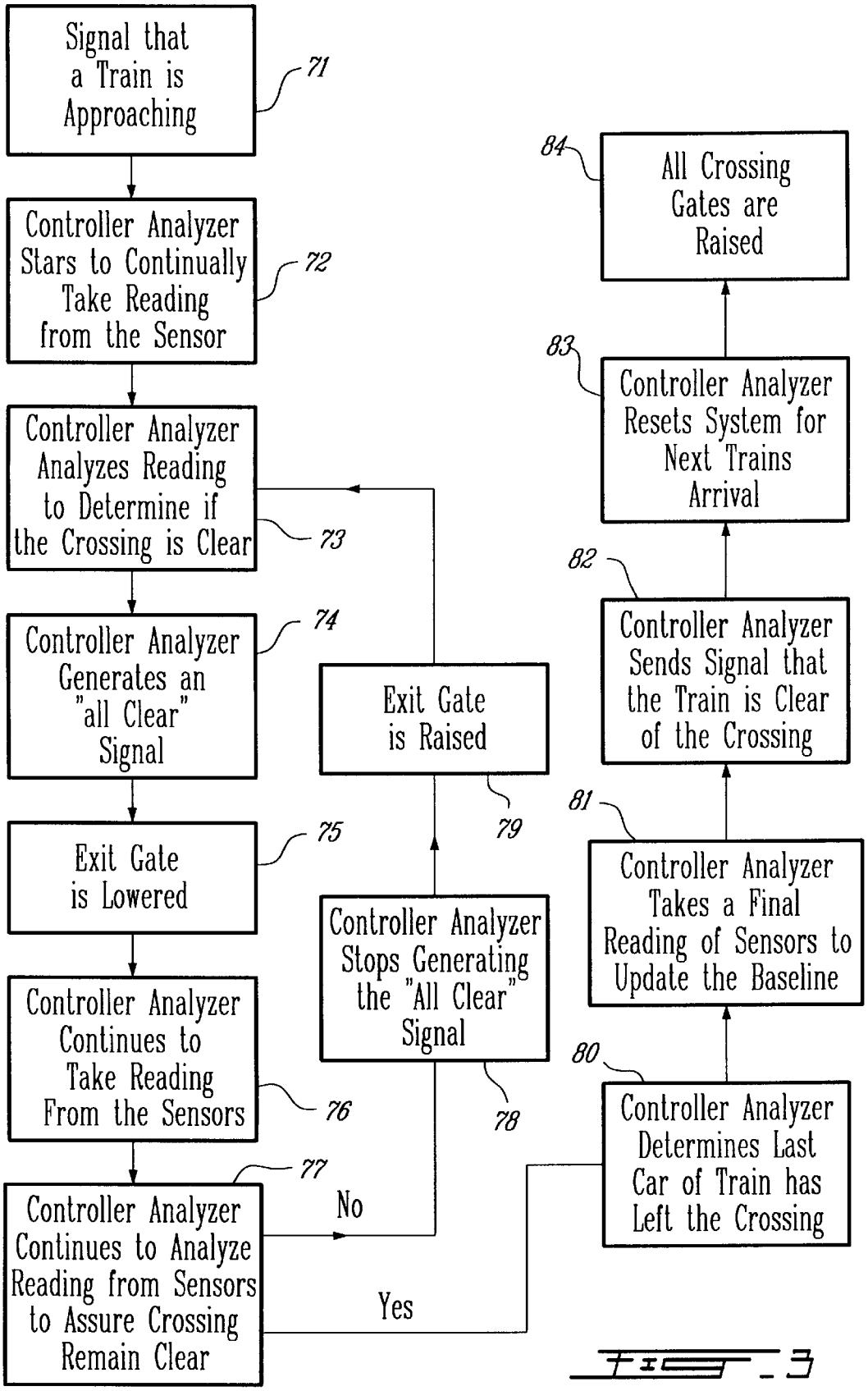
FIG. 3 is a flow chart which depicts how one preferred embodiment of the present invention would function.

III. Operation of the System:

FIG. 3 provides a flow diagram showing how the overall system functions. The controller analyzer 23 first receives a train approach signal 71 from the standard track circuitry 25. In the preferred embodiment this signal is received at least 35 seconds prior to time the train would arrive at the crossing. This particular timing requirement being built into the system. The controller analyzer 23 then initiates a periodic sequential reading 72 of each of the primary sensors 41 to 46. Two or three seconds after the train approach signal is received, the vital relay network 24 will, without any prompting from the controller analyzer 23, lower the two entrance gates 33 and 37 to crossing 30. This aspect is not noted on FIG. 3 since it does not relate directly to the function of the system of this invention.

Controller analyzer 23 continues to analyze the readings from the sensors until it determines that the crossing is clear of any vehicles 73 and then generates an all clear signal 74. The controller analyzer 23 is conducting this analysis separately for each lane of vehicle traffic across the protected area of the crossing. Thus when it generates the all clear signal it is only for the lane or lanes which it has determined are in fact clear of vehicles. If it determines that one of the lanes is not clear of vehicles it will withhold the all clear signal for that lane until it determines it is in fact clear of any vehicles.

Once the controller analyzer determines a lane is clear and generates the all clear signal 74 this signal is received by the vital relay network which then lowers 75 the exit gate, either 35 or 39, for the lane it receives the all clear signal from the controller analyzer. Naturally, if an all clear signal is received for both lanes it will lower both gates.

However, even after generating the all clear signal for a lane or for both lanes and before the train arrives at the crossing the controller analyzer continues to periodically and sequentially take readings 76 from the sensors and analyze those readings 77 to verify that the lanes remain clear. If at any point prior to the arrival of the train at the crossing the controller analyzer determines the lanes are not clear and a vehicle or vehicles are in one or more of the lanes, it will remove the all clear signal 78. However, it will only remove the all clear signal for the lane which appears to have the vehicle in it. Such a situation could occur if a small maneuverable vehicle such as a motorcycle tries to run the crossing by maneuvering around the gates or a vehicle crashes through one of the gates.

Upon receipt of the signal removing the all clear signal the vital relay network will raise 79 the exit gate of the affected lane or reverse the closing of the exit gate if it is still in the process of lowering. The controller analyzer then continues to analyze the readings from the sensors 73 and if it determines the lane is finally clear it will then regenerate an all clear signal 73 for the affected lane. Thus prior to the arrival of the train at the crossing the controller analyzer of the present invention will be cycling through steps 71 to 77 for each lane as indicated in FIG. 3.

When the train has entered the crossing the next action by the system occurs after the last car of the train leaves the crossing. The controller analyzer will determine 80 that the last car of the train has left the crossing 30. It can do so in at least two ways either upon receipt of a signal from the standard track circuitry that the last car of the train has left, or based on its own analysis of readings from the sensors it is connected to in the protected area 32.

After determining the last car of the train has left the protected area of the crossing the controller analyzer takes one last reading 81 of the sensors prior to the raising of the gates to update its baseline record of what the readings from the sensors should be when the protected area of the crossing is free of any vehicles. The controller analyzer then would reset the system 83 to await the approach of the next train.

As an option the controller analyzer can be programmed to send a train clear signal 82 to the vital relay network and thus initiate the raising of all of the crossing gates 84. Generally, the standard train circuit sends this signal to the vital relay network.

One skilled in the art after reviewing the above description, will have no difficulty in designing and building the necessary electronic circuitry, logic circuits and computer programs necessary to implement the above described system. Thus such details have not been included.

IV. An Example of a Preferred Embodiment of the Invention:

A. INTRODUCTION

The following description will provide an example of an installation of a preferred embodiment of the present invention. It provides a fairly detailed description of several of the important aspects of a vehicle detection system using passive magnetic sensing of the present invention described in somewhat more general terms above. The system and features to be described are designed for, but not necessarily limited to, control of exit gates in a railway grade level crossing employing four-quadrant gates. The function of the system in this application is to sense motor vehicles in the crossing when a train is approaching, open the appropriate exit gate or gates until the vehicles exit or enter designated escape zones, and thereupon close the gates in order to keep additional vehicles from trespassing. In reviewing the following preferred embodiment it will become apparent that the system as implemented herein differs in a few significant aspects from the preceding general description. This in part results from the specific design criteria required during the implementation of the following installation. However, both the preceding description and the following are equally valid designs which are fully functional in the appropriate setting. The only significant exception being that it was found for detection of stationary motor vehicles a separation of on the average of no more than eight to twelve feet between sensors was necessary. It will also be noted that the preferred embodiment of the system described herein does not include functions 81 and 82 listed on FIG. 3. This is due to the fact the present system has an alternate preferred way of setting the base line 82 and the design criteria did not call for detection 81 of when the train has left the crossing area although this function can be easily added.

However, this system can be easily adapted for a variety of other uses where movement of vehicles or similar objects have to be monitored as they move through an area where some type of monitoring is needed for safety, control or some other similar purpose. One could easily adapt the system for use at a roadway intersection to control traffic lights, provide remote sensing of vehicular traffic density or some similar purpose. Depending on the situation, the actual particulars of installation will vary. However, the present disclosure provides sufficient information so that those skilled in the art can make appropriate decisions on how to install a working system. Among possible additional uses of this system are the following: a.) detection of potential intrusion of railroad cars on a siding onto an adjacent main line; b.) detection and communication of vehicle presence on or near tracks in a yard where remotely controlled locomotives are used; c.) verification of switch position by detecting magnetic fields from moveable rails; d.) use as a train approach alerting device for railway work crews; e.) verification that a highway-rail vehicle has left the tracks at an intersection; f.) recording all movements, including the direction of movement, at a crossing, especially transgressions which occur, i.e. movement of vehicles across the protected area during the approach of a train; g.) communicate to an engineer on a train moving towards a crossing activity at the crossing and indicate potential dangerous situations which may exist which would require an emergency stop prior to reaching the crossing (for example a vehicle stalled on the crossing such as a large truck); and h.) the system also has broad use for detecting and monitoring vehicles or other objects which affect the ambient magnetic field in a specific area.

The four quadrant system as currently configured uses fluxgate-type magnetometers, but it should be understood that other types of magnetometers having equivalent sensitivity, dynamic range, and frequency response could be used. The essentials of the system lie in the manner in which the sensors are placed and oriented, in the methods by which the sensor data is processed to obtain proper system functioning, and in the methods of assuring reliable and fail-safe system operation. Portions of these subsystems have stand-alone aspects and could be individually transported to other applications, but there are also interrelationships of an innovative nature.

Some important aspects of this preferred embodiment of the system which will be discussed in detail are as follows:

1. Sensor placement, axis complement, orientation, and burial depth.
2. Sensor data processing and threshold detection.
3. Magnetic ambient baseline establishment and maintenance.
4. Gate Control Systems.
   a) Individual traffic lane vehicle detection.
   b) Vehicle crossover anticipation.
   c) Centerline vehicle detection.
   d) Sub-threshold aggregate-sensor vehicle detection.
   e) Escape zone vehicle detection.
   f) Train vs. vehicle discrimination.
5. Self-test mechanism.

Figure 4:
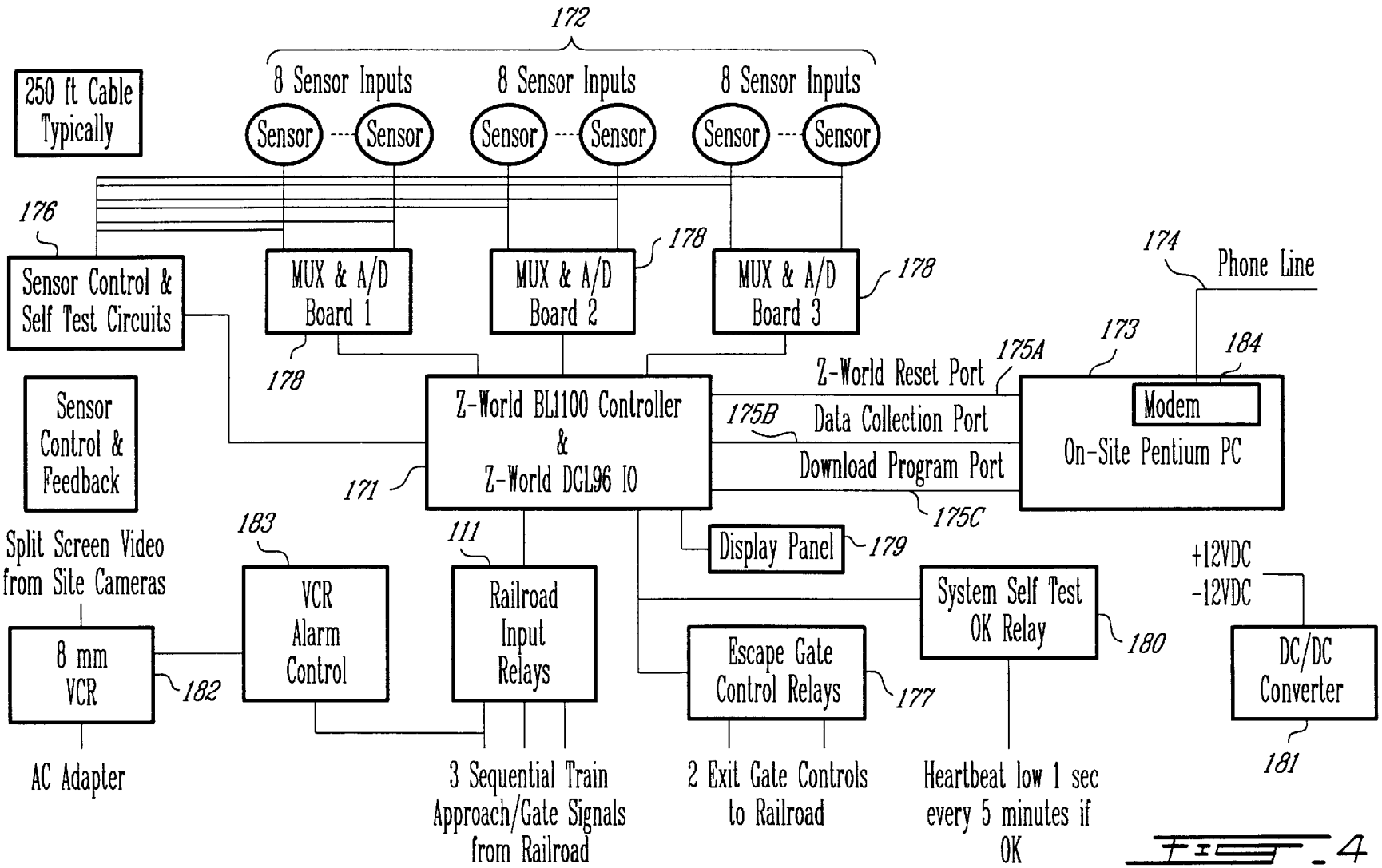
FIG. 4 is a block diagram of an example of an installation of a preferred embodiment of the present invention.

FIG. 4 provides a block diagram of the major functional components of the system of the preferred embodiment described herein. Not all of the functional blocks shown therein are necessary for the present disclosure. In this system, a microprocessor-based controller 171 is used to perform all digital functions, but it should be understood that other means (for example, programmable logic arrays) could be substituted in its place and the same results achieved. Controller 171 can be any standard computer with appropriate memory, computing and input output capabilities. In the preferred embodiment a BL1100 manufactured by the Z World Corporation has been used. Controller 171 receives sensory inputs from the sensors 172 through multiplexing analog to digital converters 179A, 179B and 179C. Units 179A, 179B and 179C sequentially sample each of the sensors 72 to which they attach multiplex the signals and then converts the signal from an analog to a digital signal and sends it to controller 171. Controller 171 connects to Railroad Input Relays 111 which are in effect the standard track circuitry 25 which warns of an approaching train and the vital relay network 24 which controls the entrance gates 109 and 106 of FIG. 5. Controller 171 also controls the exit gates through connection 111 of FIG. 4. Railroad Input Relays 111 also connect to and control an observation VCR alarm control 83 which in turn controls a VCR 82 which are not of particular importance with respect to the present invention.

Escape gate control relays 177 to which controller 171 attaches allows it to control gates to each of the escape lanes 103 and 102. System self test ok relay 80 provides the means for the controller 171 to signal to the rest of the railroad that the system is functioning with in parameters. The system has self testing circuitry 176 which works in a standard fashion as well as a simple display 179 which in the preferred embodiment consists of LED's which provide information on the operation of the system. Power to the system is provided by a standard unit 81. Controller 71 also connects via bus 175 to an on site PC 173 which will be discussed in some detail below.

Figure 7:
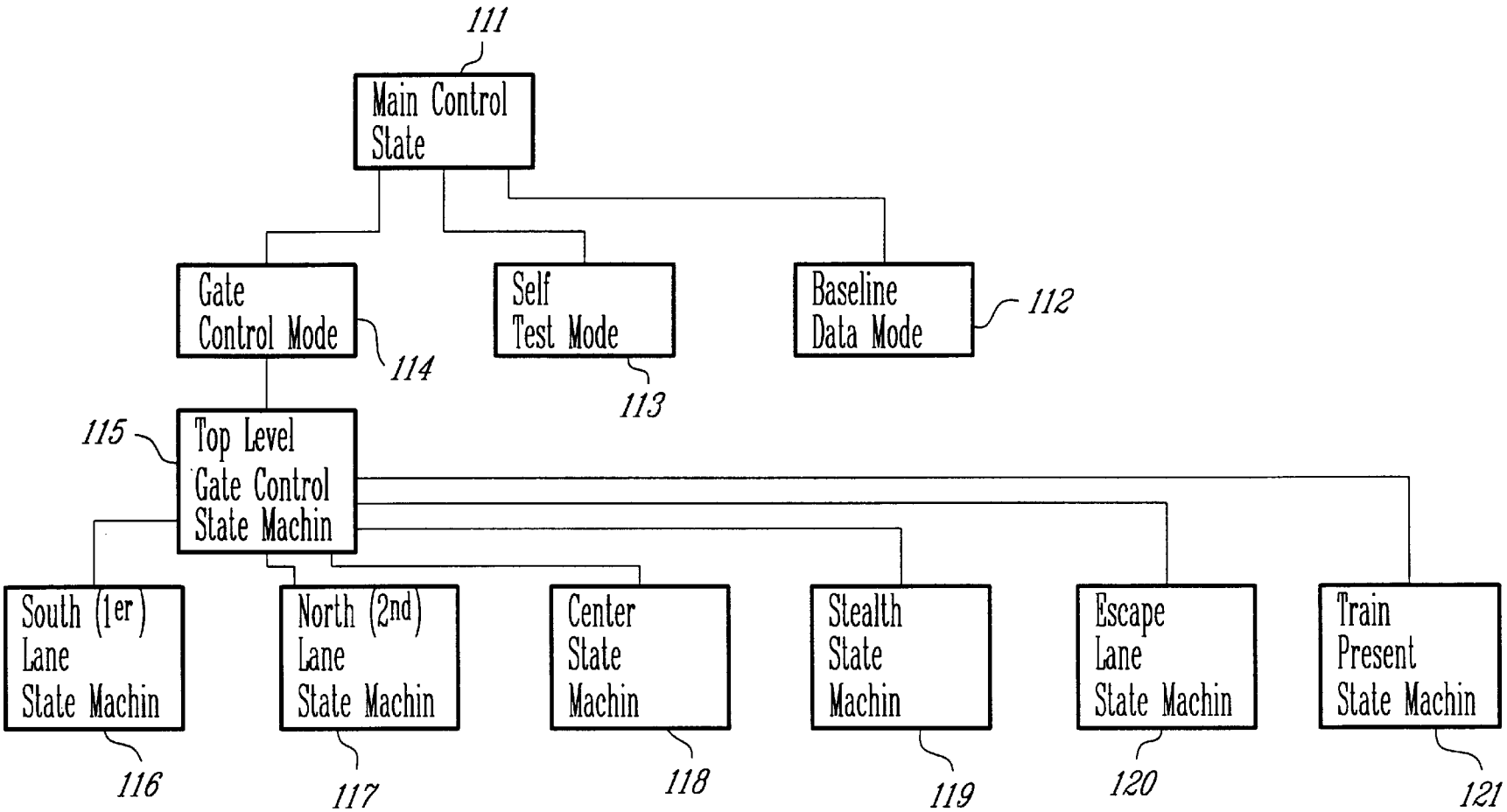
FIG. 7 provides a block diagram of the various operating modes and related state machines of the present invention and their interrelationship.

FIG. 7 provides an overall block diagram of the major functional states of the present invention. The following will provide a brief introduction to these states which will be described in detail below. Naturally, these functional states are being executed by the appropriate software program or programs which are running on controller analyzer 71 of FIG. 4 which in turn is working with and controlling the other hardware items depicted in FIG. 4. The system has a main control state 111 of FIG. 7 in which it operates and controls the three main modes of operation: a.) baseline data mode 112, b.) self test mode 113 and c.) gate control mode 114. Operation in each of the modes depend on timing and the circumstances or events as they occur. The system does not go into the gate control mode 114 unless a train approach signal is received from the standard track circuitry. The system periodically runs a self test mode to determine if the sensors and other aspects of the system are functioning properly. In the preferred embodiment as described below the self test mode runs every five minutes. The baseline data mode as will be described in more detail below is constantly updating the ambient magnetic baseline to adjust for changing ambient magnetic conditions in the area of the crossing.

When the system enters the gate control mode 114, as the result of receipt of a train approach signal, this activates the top level gate control state machine which then runs in parallel six other state machines which state machines provide the top level gate control machine 115 with the necessary data to determine if the exit gates can be closed or whether one or more of the exit gates should remain open to allow a vehicle detected in the protected area of the crossing to escape. The six state machines the top level state machine 115 controls are the: a.) the south or first lane state machine 116 which monitors the first lane to determine if a vehicle is in the protected area, b.) the north or second lane state machine 117 which monitors the second lane to determine if a vehicle is in the protected area, c.) the center state machine 118 which monitors the space between the first lane and the second lane to determine if a vehicle is in the protected area, d.) stealth state machine 119 which provides the additional capability of being able to detect vehicles which the other state machines may have missed by analyzing readings from all of the sensors, e.) the exit lane state machine 120 which monitors activity in the escape lane and f.) the train presence state machine to determine if and when a train has entered into the protected area of the crossing.

B. DESCRIPTION OF RELEVANT SYSTEM ASPECTS

1. Sensor Array:

The functional requirements for the sensor array, sensors 85 to 98 are as follows: a) Complete coverage of the crossing (no "dead" spots), b) Determination of vehicle path and direction, and c) Minimization of spurious response to non-vehicle stimuli Satisfaction of these requirements is provided by the techniques described in the following sections.

1.1 Sensor Array Spacing and depth

Passive magnetic detection depends on the existence of ferromagnetic materials in the target vehicles, which constitute magnetic dipoles either induced by providing a low-reluctance path for the geomagnetic field, or due to residual magnetism in the various parts of the vehicle. Magnetostatic theory teaches that the field from a dipole falls off as the cube of its distance from the sensor; thus, for practical purposes its range of influence does not much exceed its physical dimensions. This physical fact, supported by magnetic signature data, has both beneficial and detrimental consequences. On the one hand, it helps localize vehicle presence; on the other, it requires that sensor spacing be on the same order as vehicle dimensions, and that burial depth be as shallow as possible consistent with freedom from damage by vehicles or road maintenance work. Depths of 18 to 24 inches have been found to be satisfactory for burial of the sensors 85 to 98 of FIG. 5.

Figure 5:
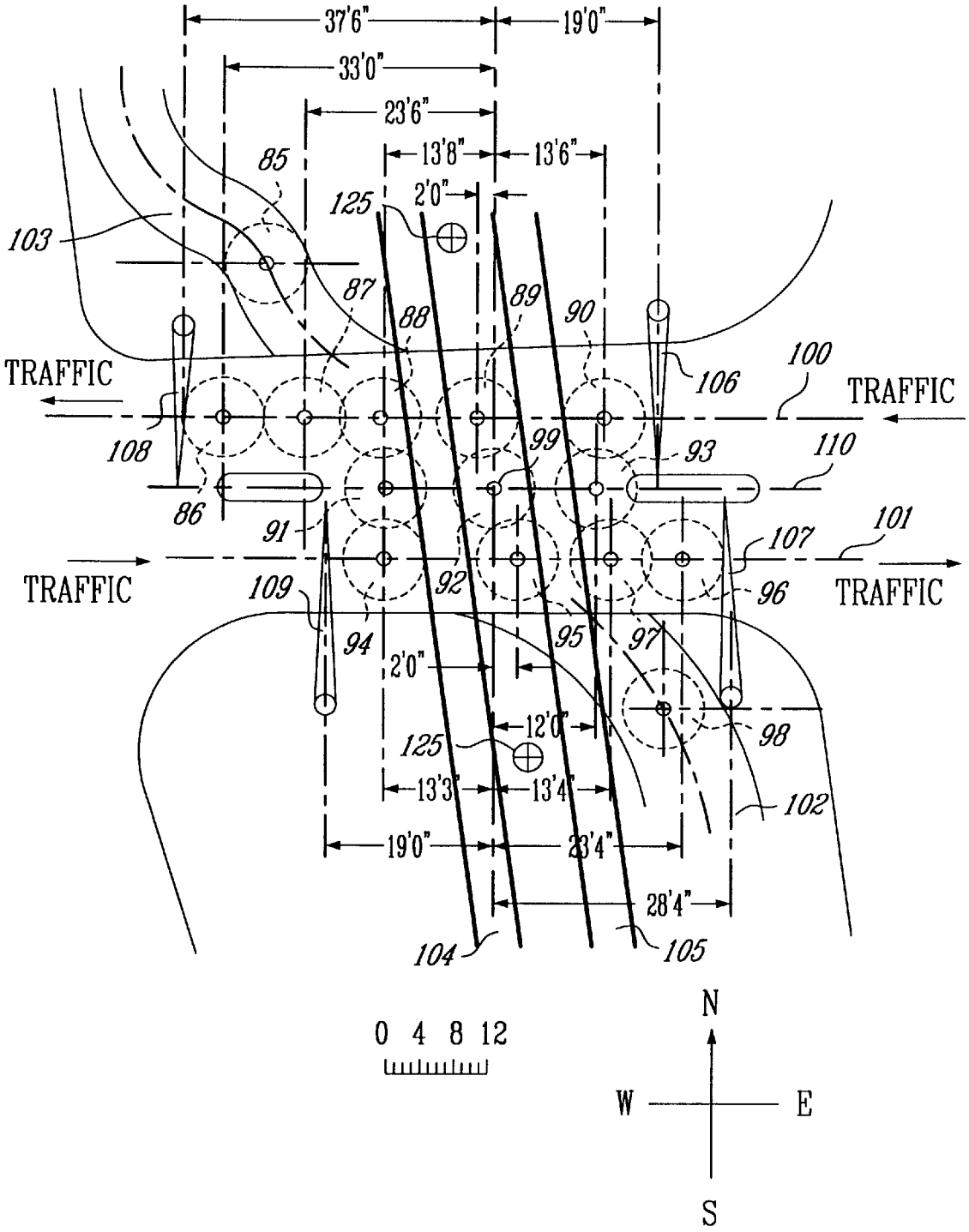
FIG. 5 is a diagram of a preferred embodiment of the present invention at a four gate crossing.

Extensive tests have shown that a sensor-to-sensor spacing of about 8 feet is needed to provide continuous detection of motor vehicles. Unfortunately, the physical circumstances of the crossing may make uniform spacing impractical. For example, locating sensors under existing surface-smoothing rubber rail aprons and under the tracks may cause railroad concern regarding roadbed integrity. A technique (described later herein) has been developed to permit limited use of wider spacing in such critical areas, based on the examination of analog data from a multiplicity of sensors rather than on an individual basis. This technique permits spacing of up to 12 feet between the sensors to be used in isolated areas, provided that normally spaced sensors are interposed. FIG. 5 depicts such a spacing where the distance between the three sensors 95, 92 and 89, which lie between rail beds 104 and 105 and the sensors on either side sensors 88, 91 and 94 as well as sensors 97, 93 and 89 is greater than 8 feet being on the order of 12' apart. Rail beds 104 and 105 causing the problem.

In FIG. 5 in addition to the lines of sensors in both roadway lanes 100 and 101, a third row 91, 92 and 93 is included along the center line 110 of the roadway, in order to augment coverage and permit tracking of vehicle paths. The geography of the crossing dictates the number of sensors necessary given the constraints on where they can be placed while trying to maintain a distance of no more than 8 to 12 feet between them. Thus, west roadway lane 100 has five sensors 86, 87, 88, 89 and 90. The East roadway lane 101 has four sensors 96, 97, 95 and 94. The center line 110 has three 93, 92 and 91. Also, sensors 98 and 85 are provided in the escape lanes, to confirm legitimate use thereof or illegal usage of the escape lanes during periods of no train passage.

1.2 Axis Complement and Orientation

Figure 6:
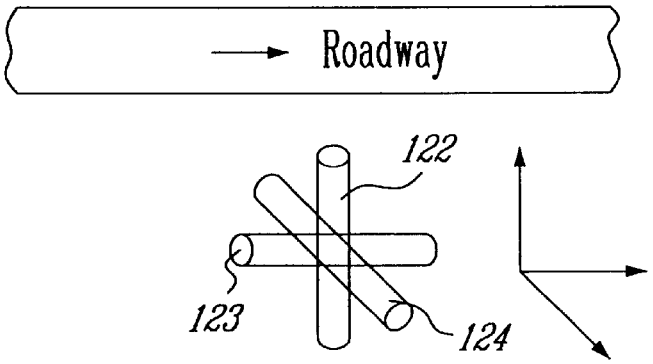
FIG. 6 illustrates the basic structure of a three axes sensor.
Figure 6A:
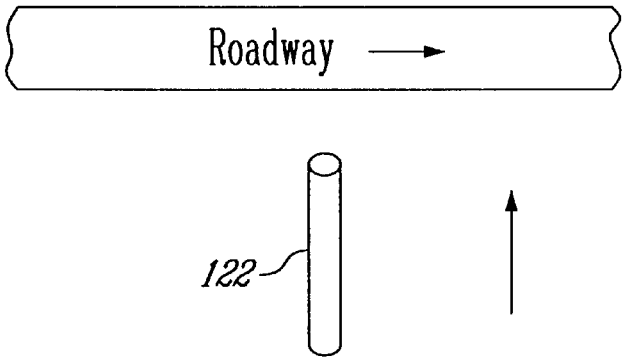
FIG. 6A depicts a single axis sensor in which the axis has a vertical orientation.

The general description of the invention discussed above employed a three axes sensor with the three axes of the sensors in an orthogonal relationship to each other as depicted in FIG. 6. However, in practice it often is not necessary that each sensor have the three orthogonally positioned sensitive axes and that, as will be described herein, a sensor with only one or two appropriately positioned axes can provide good readings. For example in high magnetic latitudes, as found in most of the continental U.S. and Canada, the predominantly vertical nature of the geomagnetic field causes the best vehicle localization, and the most reliable detection, to be afforded by vertical 122 orientation of the magnetometer sensitive axis as depicted in FIG. 6A. The concentration of geomagnetic flux by ferromagnetic objects such as motor vehicles leads to an enhanced vertical field when the object is over the sensor, and to less prominent reductions of the field when the object is nearby but not directly over the sensor.

It therefore follows that the sensor array should incorporate vertical-axis response. However, important information can also be gained by including a horizontal-axis capability, at least at certain critical points in the sensor array. In particular, it is possible to determine whether the vehicle is east or west (or north or south) of the sensor by using horizontal-axis information. Also, adding horizontal sensitivity aids in implementing the above mentioned, and later described, use of aggregate sensor data to fill in "holes" in coverage.

Figure 6B:
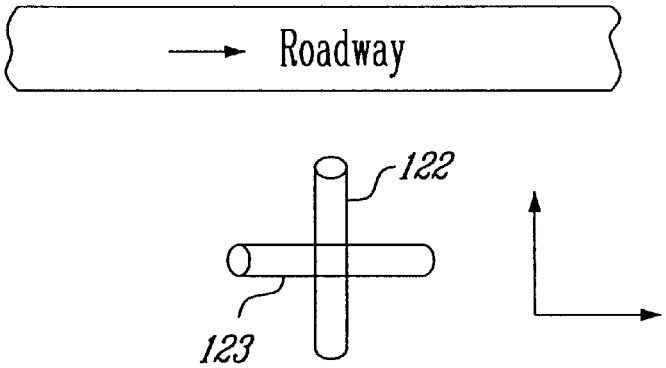
FIG. 6B depicts a dual axes sensor with one axis in a vertical orientation to a roadway and the second axis in horizontal orientation and parallel to the roadway.

It can be shown from magnetostatic theory, given the presence of a vertical geomagnetic field, that a magnetically permeable body above and to the left of a sensor produces a horizontal field component with a rightward orientation, and vice versa. Thus, a sensor with a horizontal axis 123 oriented parallel to the roadway as depicted in FIG. 6B, can be used to determine vehicle direction as it passes, or whether a stopped vehicle is on one side or the other. This is a particularly useful feature for the sensors closest to the entry and exit limits of the crossing, namely sensors 86, 94, 96, 93 and 91, since the information can be used to verify that a vehicle has cleared the crossing, or that a waiting one is still outside the limits and not encroaching on the protected area.

As a minimum, it is therefore advantageous that these outer sensors 86, 94, 96, 93 and 91 have a horizontal axis capability parallel 123 to the roadway as depicted in FIG. 6B. As an alternative the sensors of the exit and entrance lanes 86, 94, 90 and 96 and the center line sensors 91, 92 and 93 can each have a horizontal axis and a vertical axis to provide the necessary coverage. Naturally, in the ideal situation every sensor would have all three axes 122, 123 and 124, but as a practical matter cost and other circumstances may prevent this. Also, information useful in discriminating between roadway vehicles and trains can be derived from the horizontal-axis field.

2. Sensor Data Processing and Threshold Detection

Sensor data processing, as used herein, means analog and digital filtering applied to the raw magnetometer outputs, for the purpose of optimizing the signal-to-noise ratio (that is, allowing the desired vehicle waveforms to pass through, while minimizing response to unwanted magnetic or electric disturbances). These disturbances result from nearby power lines, from stray electrical currents in the rails and other nearby conductors, from nearby electrical storms, and from the deliberate introduction of currents in the rails in conjunction with railway signal systems.

Since parked or stalled vehicles must be detected, the frequency response of the magnetometers must extend to arbitrarily values (i.e., to DC.) Thus, the main filtering option available is the limitation of the sensor output bandwidth to the lowest value which will permit reliable vehicle detection.

In the four quadrant gate application, only low speed vehicles need be detected, because a vehicle moving at high speed cannot stop in the protected area and will either be out of the crossing before the gates descend or will crash through the gates. For example, a vehicle traveling at 30 mph (44 feet per second) will traverse a typical intersection in about 1 second. If its range of magnetic influence spans 8 feet, its signature at any one sensor will occupy about 200 milliseconds. If that period is equated to one cycle of the characteristic frequency involved, a sensor bandwidth of only 5 hertz is needed.

2.1 Filtering

Many of the disturbances noted above are impulsive or step-function in nature, with amplitude rise times short relative to vehicle periods. It is well known in the art that fast rise times can result in "ringing" or damped oscillations in the output of sharp-cutoff analog filters, which resemble legitimate waveforms. Therefore, it is advantageous to use analog filtering with gradually increasing attenuation vs. frequency as a first line of defense, and to use finite-impulse-response (FIR) digital filtering to achieve high attenuation of transient noise. In the present embodiment of a four-quadrant exit gate control system, the analog filtering is achieved via simple resistance-capacitance networks (cutoff frequency 8 hertz, 6 decibels/octave roll-off) in each sensor assembly 72 FIG. 4.

After analog-to-digital conversion of the sensor outputs (which is necessary in any event because digital means are used to process sensor information and control the gates), the digitized sensor outputs are further filtered using a custom FIR algorithm designed specifically for the application. It is unique in that it achieves the needed cutoff characteristic using a minimum-complexity, 3-tap, unity-gain algorithm design, an important feature in this real-time application where large amounts of data must be processed between successive samples of the sensor outputs. With 18-hertz cutoff frequency, the digital filter adds no significant attenuation at 8 hertz, but it provides high attenuation of power-line frequencies, AC signaling currents, and various sources of impulsive noise. At the same time, the analog networks provide over 15 dB of attenuation above the sampling frequency of 45 hertz, thus protecting against aliasing of higher-frequency signals into the digital pass band. The discussion of filters herein does not go into the details of implementation since analog and digital filters are well known in the art and those skilled in the art should have no significant difficulty in selecting and implementing the appropriate filters.

2.2 Threshold Detection

In any practical installation, the total elimination of all spurious magnetic and electrical influences cannot be achieved; thus, it is necessary to set some minimum level of influence that can be regarded as that of an actual vehicle. Furthermore, such a threshold is necessary to eliminate "crosstalk", i.e., a vehicle in one lane appearing to also occupy the other.

At high magnetic latitudes, the sensor orientation which yields the most reliable vehicle detection and its best localization has been found to be with the sensitive axis in a vertical position 122 as depicted in FIG. 6A; i.e., with it more or less aligned with the geomagnetic field. With this orientation, the field change peaks when the vehicle is directly over the sensor, and it represents an enhancement of the geomagnetic field. Since vehicles off to the side of the sensor tend to reduce rather than augment the geomagnetic field, requiring that the field change for vehicle detection be that of enhancement yields good lane discrimination, while also utilizing the maximum-amplitude portion of the change.

Naturally, in lower magnetic latitudes closer to the equator the conditions will change and a different orientation of the axes of the sensors will provide better readings. However, the present example should serve as an appropriate guide for achieving proper orientation at such lower geomagnetic latitudes.

Threshold setting inherently involves compromise between reliable vehicle detection and maximization of the signal-to-noise ratio, and the optimum setting may vary depending on local conditions and on the geometry of the crossing. For the present embodiment, it has been found that thresholds of 30 to 40 millioersteds are suitable, but these values should not be considered to be restrictive. (Note that these levels represent about 6 to 8 percent of the typical geomagnetic background.)

It is desirable that hysteresis be provided in the threshold, that is, when a vehicle is present, the field change must fall to a level below the original detection threshold before it is deemed to have left. The hysteresis serves two purposes. First, actual signature waveforms are not smooth curves, because the ferromagnetic structure of vehicles is complex in shape, variable in road clearance, and may include areas of permanent magnetism which locally aid or oppose the geomagnetic effect. Second, superimposed magnetic and electrical background noise also contributes to some waveform irregularity. Hysteresis thus minimizes multiple detections of a single vehicle, and prevents "chattering" of the detection due to noise. In the present embodiment, the field change must fall to less than 20 millioersteds to constitute vehicle departure, but different values may apply to other situations.

2.3 Directional Determination

At the entry and exit points of the crossing, it is desirable to know when a vehicle is no longer present at the sensor and whether it has entered or has left the intersection. This is of particular importance at the exit gates, since a common method of circumventing the main gates is to enter via one exit, cross over, and leave via the other. It was noted in Section IV. B.1.2 that (in high magnetic latitudes) a vehicle to the left of a sensor augments the horizontal field in a rightward direction, and vice versa. Thus, if the sense of the horizontal field change is determined when the vertical field change falls below the lower hysteresis limit, the vehicle direction is identified.

For example, consider an east-west roadway with westbound traffic in the north lane and eastbound in the south. Consider further that the sensors are installed with the horizontal axes parallel to the road and in the sense that an increase in indicated horizontal field implies an eastward augmentation. Then a horizontal-field increase implies that the vehicle is west of the north exit sensor, or out of the crossing, while a decrease implies that one is east of the south exit sensor and likewise clear of the intersection; the conditions for vehicles entering via the exit sensors are obviously the opposite. The horizontal sense check is a simple and effective method of determining direction.

3. Magnetic Baseline Establishment and Maintenance

In practice systems requiring detection of arbitrarily slow or static vehicles, have an inherent problem in distinguishing field changes due to vehicle presence from the effects of changes in the sensor outputs due to other causes. The latter may be due to actual changes in the magnetic ambient, or to drifts in circuit parameters due to temperature or aging. The problem is a delicate one, in that correction of spurious changes must only be undertaken if it is certain that a vehicle is not involved. The currently established sensor output levels, in the absence of vehicular influence, is herein referred to as the "baseline", and is stored in controller memory for use in determining sensor output levels corresponding to vehicle detection and departure.

One way of establishing a corrected baseline (without manual intervention) is to do so at a time of day when vehicle activity is minimal, for example, at 3 AM. Such a periodic correction has two disadvantages; first, there is no positive guarantee of inactivity, and second, an ambient shift can persist for 24 hours before it is corrected. One example of such a condition might be when a vehicle drops a muffler or other ferromagnetic part in the intersection, or roadway or track work alters the magnetic ambient.

A method has been developed for correcting the baseline on a more or less continuous basis, as conditions permit. It is based on the following:

a) A continuous process, in the absence of vehicle detection or a train passage, of collecting, averaging, and finding minimum and maximum deviations of sensor outputs over fixed, short time periods (approximately 45 seconds in the present embodiment). In the preferred embodiment an array of 17 sample groups, each covering approximately 2.84 seconds and containing 128 successive samples, is maintained for each sensor, with 16 sample groups constituting a 45.5 second period. The oldest sample group is replaced by a new sample group while the remaining 16 are processed. Thus, a rolling window of data is evaluated, every 2.84 seconds, rather than of one based on a 45.5 second delay while a new sample set is accumulated. The rolling window offers the best opportunity of finding a quiet period during luls in vehicular traffic through the crossing.

b) Regarding the averaged data so obtained as representing a valid baseline only if the maximum and minimum sensor output levels within sample groups and over an entire 45.5 second period during the sample period fall within a narrow, established range (10 millioersteds peak to peak has been found satisfactory in the present embodiment);

c) Adopting the new baseline only if one or more sensors exhibit an average change exceeding a specified value (currently 7.3 moe).

The condition of c.) above is a somewhat arbitrary one, and although it has yeilded satisfactory results, there in no compelling argument against adopting a new baseline each time that one is declared valid. The latter technique has the advantage of minimizing the effects of small sensor drifts on the multiple-sensor summations used in the Stealth State Machine (see section 4 (d)).

The requirement that no vehicle be present during the data collection interval prevents a stalled or parked vehicle from being "baselined in" and therefore subsequently not detected.

4. Gate Control System:

The exit gate control process involves the parallel operation of several state machines utilizing various combinations of sensors. (The state machines are in essence different software routines programmed into the controller 171 which take the readings from a specific set of sensors and analyzes the readings and make a determination based on those readings regarding vehicle presence and direction of motion in the sector the sensors from which they acquire their readings.) FIG. 7 provides a schematic diagram of the state machines and their functional relationship. In the present embodiment, these are the North State Machine, the South State Machine, the Center State Machine, and an aggregate-sensor state machine (referred to as the "Stealth" State Machine because its purpose is to detect vehicles missed by the other state machines). It is a fundamental principle of the design that all state machines must agree to close the exit gates before such action can be taken; this is important for safety reasons. Any one machine can open the relevant exit gate or gates after they have been closed.

These state machines work in conjunction with a top-level gate control state machine which is invoked when a train approach signal is received and remains in control until it is lifted. The top level machine opens and closes the gates, generates time delays needed for the other state machines, and includes a routine for recognition of train arrival based on sensor tripping patterns. This routine effects changes in the functioning of the other state machines, to prevent gate openings due to influence of the train on the sensor array.

It should be pointed out that the state machine and sensor complements may vary for different crossing configurations. For example, a one-way street would require fewer sensors and state machines, whereas a multiple-lane highway might require more. Obviously, "North" and "South" notations would be replaced by ones appropriate to the orientation of the intersection.

State machine operation begins when a signal indicating train approach is supplied by a separate system the standard track circuitry 25 which then signals the vital relay network 24 which then actuates the main (or entry) gates. The exit gate control system which is the subject of this description then permits or denies lowering of the exit gates, depending on whether or not the crossing is determined to be clear of any trapped vehicles. The state machines function as follows:

a) Individual Traffic Lane Vehicle Detection

The North and South state machines open their respective exit gates if any sensor in the lane detects a vehicle, and close that gate only if it is known to have exited via the corresponding exit gate or via the escape lane, or if it is no longer detected and one or more of the other state machines have recognized its presence.

b) Vehicle Crossover Anticipation

When a vehicle enters an exit gate, it is reasonable to assume that its operator intends to exit via the opposite exit gate. In order to allow ample time for that gate to open, a "crossover" state is provided in the North and South state machines, which permit them to open their counterpart gates when entry via an exit gate is detected. The state machine which initiated the crossover action relinquishes control of the opposite gate when its lane is clear and it is confirmed that another state machine has recognized the vehicle presence and is in control of the appropriate gate.

c) Centerline Vehicle Detection

In the present embodiment, three sensors 91, 92 and 93 are placed along the center line 110 of the two lanes FIG. 5. These sensors serve two principal functions via the Center State Machine. First, they provide coverage in areas where a vehicle might not be detected by the in-lane sensors; and second, they indicate that a vehicle is in transition between lanes and cause both gates to be opened and remain so until the vehicle clears the center area and is detected by one of the lane state machines.

d) Stealth State Machine

To further guarantee complete coverage of the crossing, despite the non-ideal sensor spacing as depicted in FIG. 5, the Stealth State Machine sums the outputs of groups of sensors. It is subdivided into north and south gate control sections, and operates in the following manner:

i) All sensors and available axis in a given lane are used for that lane section, except that the exit gate sensors are excluded from use by this state machine because the staggered-gate configuration exposes them to the highest level of fields from vehicles outside the crossing.

ii) The absolute values of the deviations from baseline for each sensor and axis in a given lane are used, and added together for comparison to stealth threshold trigger and dropout levels which are of the same order as those described above for a single sensor.

iii) Horizontal axis data for the entry sensors are included only if the polarity of the change corresponds to a vehicle in the crossing, rather than one stopped outside the crossing but close to the entry gate.

iv) Absolute values of the centerline sensor deviations are added into both the north and south sections, but the total centerline contribution is limited to a value less than the stealth threshold. This allows the centerline group to augment both sections for vehicles with low magnetic moment, while preventing false vehicle detection in one lane due to high magnetic moment vehicles in the other lane.

e) Escape Zone Vehicle Detection

Data from the sensors in the escape lanes are processed using the same threshold criteria as those in the roadway. The data are used for two purposes: first, as a backup confirmation that a vehicle in the crossing while a train event is in progress has actually entered the escape lane and is therefore clear of the tracks, at which point the adjacent exit gate may be lowered; and second, to detect the illegal occupation of the escape zones while no train event is in progress. The latter condition is likewise treated in two ways; first, a relay is actuated in order to provide a signal to the railway interface, so that the proper authorities can take action to have the vehicle removed; and second, if a vehicle is present in an escape zone at the initiation of a train event, that lane is excluded as an escape means for a trapped vehicle, and the exit gate is kept open until the second vehicle exits.

f) Train vs. Vehicle Discrimination

When a train occupies the crossing, large magnetic fields are generated on all sensors within several feet of the tracks. It is necessary to assure that the influence of the train is not mistaken for that of a trapped vehicle, and therefore to keep the exit gates closed during the train passage.

In the present system, it has been found that the exit gate sensors are far enough from the tracks to not be falsely triggered by train passages; therefore, these remain active during and after a train passage, in the unlikely event that a vehicle is clear of the tracks and attempting to exit. Data from the other sensors are not utilized after train presence is recognized. The geometry of other crossings may not permit any sensors to remain active, or on the other hand may permit additional sensors to do so.

The straightforward and most reliable method for train discrimination is the installation and use of auxiliary sensors in proximity to the tracks and clear of the roadway, so that only trains can be detected. An appropriate placement of such sensors 125 and 126 would be 10 to 20 feet out from the crossing and its protected area. Thus, these sensors 125 and 126 could indicate when the train has entered the crossing and when it has left. The system then could also be used to indicate when the gates could be raised. In the event such sensors can not be installed for whatever reason such as permission to install such sensors could not be obtained an alternative method for train discrimination has been devised. It utilizes the fact that a train will create its own unique pattern of sensor readings which are unlikely to be duplicated by a trapped vehicle, and do so in a time interval which is difficult for a vehicle to achieve. Operation is as follows:

i) Trains on the west track 104 are recognized if the north lane between-tracks sensor triggers, followed by or preceded by triggering of either the vertical axis of the south lane entry sensor vertical axis or its horizontal axis if the horizontal polarity corresponds to an inside-the-crossing presence.

ii) Trains on the east 105 track are recognized if the south lane between-tracks sensor triggers, followed by or preceded by triggering of the north lane entry sensor vertical axis or horizontal axis if the horizontal polarity corresponds to an inside-the-crossing presence.

iii) In order for the recognition to be valid, the second sensor must trigger within 2 seconds of the first.

iv) The train recognition algorithm is not enabled until 15 seconds after the first train approach signal is received form the standard track circuitry 25. This delay allows unimpeded operation of exit gate control during the period wherein it is certain that no train could be present, due to the minimum-warning rules which govern control of the entry gates by the railway equipment.

v) After expiration of the 15 second period, all gate control state machines are flagged to incorporate a 2-second delay before opening exit gates, in order to ascertain that the sensors are being influenced by a vehicle and not a train.

5. Self-test Mechanism:

Self-test of the system and its sensors is an essential element in achieving the fail-safe characteristics needed for a crossing protection system. Methods for self-test of digital logic are well known in the art; an important technique for so doing is the so-called watchdog timer, which must be periodically prevented from implementing a reset of the logic system by a programmed action of that system. In the case of an exit gate control system, the reset insures that the exit gates remain in the raised position until corrective action is taken. In the present system, it is stipulated by the user that self-testing must take place, and system integrity be reported, every 5 minutes.

Sensor self-testing involves special issues and corresponding innovations. The basic approach is that described in U.S. Pat. No. 5,868,360 (Bader et al) and incorporated herein by reference, wherein the supply voltage to the sensors is gradually increased to a trigger level which actuates self-stimulus of the sensors; the resulting sensor output is analyzed for proper response. The unique features of the present system involve a modified means of self-stimulation, and the manner in which self-test data are utilized to allow normal operation, demand retest, implement corrective measures, and make decisions as to sensor status at the commencement of a train approach.

i) Self-stimulus: In the referenced patent, the self-simulus is electrically coupled into the search-coil magnetometer. This is not practical with the ring-core magnetometers used in the present embodiment; a separate coil, magnetically coupled to the ring core(s) must be used. As a practical matter, wire size and number of turns limitations dictate that currents on the order of 100 milliamperes are needed for reliable stimulation. This level of current would cause significant voltage drops in the long (up to 250 feet) cables to the sensors, and would thereby inject false signals into the sensor outputs. Therefore, internal capacitors (100 microfarads) are provided in the sensors, and are locally discharged within the sensors upon receipt of the increased-voltage self-test command. The capacitors are charged through a high resistance of 100,000 ohms, and require approximately 30 seconds to recharge after a test. This delay must be taken into account before a failed sensor can be retested.

ii) It is possible that the magnetic effect of a passing vehicle may cancel the self-test stimulus and result in an apparent sensor failure. Therefore, retest is justified before a sensor can be declared defective. Furthermore, it is possible that some types of sensors, when subjected to extremely large magnetic fields, can exhibit an unresponsive "locked-up" condition which can be corrected by removal and restoration of power. Accordingly, a test sequence has been devised, which in the absence of a train event, provides for a second test after capacitor recharge; if the sensor still fails, power is removed for 15 seconds and then restored, and the test repeated. Two additional failures indicate a defective sensor, and gate control is disabled and the railway alerted.

iii) In the unusual but possible event that a vehicle has interfered with a self test and caused a spurious failure indication, and a train approach starts before retest can be conducted, a backup mechanism is brought into play to prevent unnecessary abrogation of gate control. The sensor output voltage level is examined, and if it is found to be within specified limits, it is assumed that it is operational for the present train passage only. This substitution for a full sensor test confirms that its connecting cable is intact, and accounts for most but not all types of internal sensor failures.

6. Remote Control and Monitoring of the System:

The system of the present invention has the added ability for remote monitoring control the crossing sensor network of the present invention as depicted in FIG. 4. PC 173 connects to controller analyzer 171 via three ports: a.) reset port 175A which allows the appropriate signal from the PC 173 to reset the controller analyzer 171 when the need to do exists, b.) data collection port 175B which allows for the transfer of data from the controller analyzer 171 to the PC 173 for storage in memory and retrieval at a later time or for readings of status in real time, and c.) download program port which allows for the down loading of new programs from the PC 173 to the controller analyzer 171 or for the upgrading of an existing program on the controller analyzer 171.

PC 173 connects via a modem 84 and telephone line 174 to a remote location. Thus, the controller analyzer 171 and consequently the entire system can be monitored from a remote location, in real time if necessary, to determine if the system is functioning correctly and if not where the problem exits in the system. Additionally, the system with respect to the software can be upgraded from a remote location without the need to travel into the field to up grade or diagnose trouble in the system. This obviously is of particular importance for railroad crossing systems are generally in remote and wide spread areas.

While the invention has been particularly shown and described with reference to a preferred embodiment thereof, it will be understood by those skilled in the art that various changes in form and detail may be made to it without departing from the spirit and scope of the invention.

We claim:

1. A method of detecting the presence of a vehicle in a protected area of a four gate railroad crossing and providing for the vehicles timely escape from the protected area of the crossing prior to the arrival of a train at the crossing, said method comprising the steps of:

receiving a signal that a train is approaching the crossing;

commencing sampling of readings from sensors located at the crossing;

analyzing the readings from the sensors to determine if and when the crossing is clear so that exit gates to the crossing can be lowered;

generating an all clear signal when it is determined that the crossing is free of any vehicular traffic; and lowering into place crossing exit gates.

2. The method of claim 1 wherein the step of analyzing further comprises analyzing readings from a plurality of sensors to determine which of at least two lanes for traffic through the protected area of the crossing is clear and then generating a separate all clear signal for each lane of the at least two lanes so that an exit gate in a traffic lane of the at least two traffic lanes for which the all clear signal is generated can be lowered.

3. The method of claim 1 comprising the additional step of continuing to sample the sensors, and upon receipt of sensor signals that at least one vehicle is in the protected area of the crossing to cease generating the all clear signal whereupon the exit gate is raised so that the at least one vehicle can escape from the protected area of the crossing.

4. The method of claim 1 including the step of periodically sampling readings from the sensors during periods that no vehicles are in the protected crossing area and using the readings taken to establish and verify a baseline for use in the analyzing step in determining when a vehicle is in the protected area.

5. The method of claim 1 wherein the step of receiving the train approach signal further comprises receiving it at least 35 seconds before the train reaches the protected area of the crossing.

6. The method of claim 3 further comprising the steps of:

generating the all clear signal when it is determined the protected area is again clear of vehicles;

monitoring the crossing for the presence of the train in the crossing;

determining when the last car of the train has left the crossing;

taking readings from the sensors after the last car of the train has left the crossing while it is still clear of vehicles;

generating a signal that the crossing is clear of the train; and resetting the system to await the approach of the next train.

7. The method of step 3 comprising the additional step of monitoring the movement of the at least one vehicle through the protected area of the crossing.

8. A system for determining if a protected area of a four gate railroad grade crossing is clear of vehicles and providing for the safe escape of any vehicles which maybe become entrapped from the protected area prior to the arrival of a train at the crossing, said system comprising:

a plurality of strategically placed sensors located within the protected area of a railroad crossing;

a controller analyzer apparatus to which each of the sensors have a communicative link; and wherein upon receipt of a train approach signal the control analyzer apparatus periodically takes readings from the sensors, compares those readings with a baseline and upon analyzing the comparison of the readings taken from the sensors with the baseline generates an exit gate control lowering signal when it determines no vehicles are present in the protected area of the crossing.

9. The system of claim 8 wherein at least two separate lanes traverse the protected area of the crossing and the controller analyzer can determine which lane or lanes are clear and generate a separate all clear signal for each of the at least two lanes individually so that exit gates for only the lane or lanes for which the all clear signals are generated will be lowered.

10. The system of claim 9 wherein a total of six sensors are strategically placed in the protected area and there are three in each lane of the at least two lanes.

11. The system of claim 8 wherein the controller analyzer continues to take readings from the sensors after generating the all clear signal, but before the train arrives at the crossing and upon obtaining readings from the sensors that a vehicle may be in the protected area ceases generation of the all clear signal which allows the exit gate to be raised until the controller analyzer determines the vehicle has exited the protected area whereupon it generates the all clear signal.

12. The system of claim 8 wherein the controller analyzer takes readings from the sensors to establish and verify the baseline.

13. A method for detecting the presence of a vehicle in a protected area of a railroad crossing and providing for the vehicles timely escape from the protected area of the crossing prior to the arrival of a train at the crossing, said method comprising the steps of:

receiving a signal that a train is approaching the crossing;

commencing sampling of readings from sensors located in at least one lane located in the protected area of the crossing;

analyzing the readings from the sensors to determine if and when the at least one lane is clear so that an exit gate for the at least one lane can be lowered;

generating an all clear signal when it is determined that the at least one lane in the protected area is free of any vehicular traffic; and lowering into place the exit gate.

14. The method of claim 13 comprising the additional step of continuing to sample the sensors, and upon receipt of sensor signals that at least one vehicle is in the at least one lane of the protected area of the crossing to cease generating the all clear signal whereupon the exit gate is raised so that the at least one vehicle can escape from the protected area of the crossing.

15. The method of claim 14 further comprising the steps of:

generating the all clear signal for the at least one lane when it is determined the at least one lane in the protected area is again clear of the at least one vehicle;

monitoring the crossing for the presence of the train in the crossing;

determining when the last car of the train has left the crossing;

taking readings from the sensors after the last car of the train has left the crossing while it is still clear of vehicles;

generating a signal that the crossing is clear of the train; and resetting the system to await the approach of the next train.

16. The method of claim 13 including the step of periodically sampling readings from the sensors during periods that no vehicles are in the at least one lane of the protected crossing area and using the readings taken to establish and verify a baseline for use in the analyzing step in determining when a vehicle is in the at least one lane of the protected area.

17. The method of claim 13 wherein the step of receiving the train approach signal further comprises receiving it at least 15 seconds before the train reaches the protected area of the crossing.

18. The apparatus of 8 wherein the strategically placed sensors comprises the sensors being placed so that they cover the entire protected area of the crossing and allow the controller analyzer to determine the location of a vehicle within the protected area.

19. The method of claim 1 including the further step of periodically conducting a self test to confirm the sensors which monitor the protected area are operating correctly.

20. The method of claim 19 wherein the step of periodically conducting the self test comprises conducting it approximately every five minutes.

21. The method of claim 19 wherein the step of conducting the self test comprises conducting at least one additional self test upon an indication of a failure in one or more sensors to verify the indication of failure during the first self test was not a false reading.

22. The method of claim 4 wherein the step of establishing and verifying a baseline comprises:

a) continuously collecting, in the absence of vehicle detection or a train passage, minimum and maximum deviations of sensor outputs over fixed, short time periods;

b) averaging the minimum and maximum deviations of sensor outputs so obtained;

c) using the averaged data so obtained as representing a valid baseline only if the maximum and minimum sensor output levels during the sample period fall within a narrow, established range; and d) adopting the new baseline only if one or more sensors exhibit an average change exceeding a pre-selected value.

23. The method of claim 22 wherein the fixed short time periods over which data is sampled is 45 seconds.

24. The method of claim 22 wherein the established range of the maximum and minimum sensor output levels during the sample period is 10 millioersteds peak to peak.

25. The method of claim 22 wherein the pre-selected value in the step of adopting of a new baseline is 7.3 moe.

26. The method of claim 1 including the step of filtering a signal generated by a sensor prior to the step of analyzing the reading from the sensor.

27. The method of claim 26 wherein the step of filtering comprises the step of a low band pass filtering.

28. The system of claim 8 wherein the sensors are magnetometers.

29. The system of claim 28 wherein the magnetometers are fluxgate-type magnetometers.

30. The system of claim 8 wherein the sensors placed in the protected area are buried between 18 to 24 inches deep.

31. The system of claim 9 wherein the plurality of strategically placed sensors are placed with a separation of no more than eight feet between each in the protected area such that they provide complete coverage of the protected area.

32. The system of claim 9 wherein the plurality of strategically placed sensors are placed with a separation of no more than eight feet to twelve feet between each in the protected area such that they provide complete coverage of the protected area.

33. The system of claim 28 wherein the sensors are three axis sensors with the three axis of each sensor in an orthogonal relationship with each other.

34. The system of claim 29 wherein a first axis is in a vertical relationship with the protected area, a second axis is in a parallel relationship with the direction of the vehicle lanes of travel and a third axis is in a perpendicular relationship with the direction of the vehicle lanes of travel.

35. The system of claim 8 wherein the plurality of sensors have at least a vertical axis and a pre-selected number have at least one horizontal axis parallel to the vehicle lanes of travel such that the sensors are able to provide sufficient data for the controller analyzer to determine vehicle presence, location and direction of travel within the protected area without undue redundancy.

36. The system of claim 8 wherein the controller analyzer comprises:

a. a top level gate control state machine which coordinates the operation of five subordinate state machines by acting on the readings taken by these subordinate state machines, upon receipt of a train approach signal, and to control the exit gate of the crossing:
   (i.) a first lane state machine for detecting vehicles in a first lane;
   (ii.) a second lane state machine for detecting vehicles in a second lane;
   (iii.) a stealth vehicle state machine for detecting vehicles not detected by the first lane or the second lane state machines;
   (iv.) a train detection state machine which can detect the presence of a train in the protected area;
   (v.) a center state machine for detecting the presence of vehicles between the first and second lanes;

b. a self test mechanism for verifying the proper functioning of the components of the system; and c. a baseline update mechanism for updating a baseline the sensors of the system use to determine if a vehicle is present.

37. The method of claim 1 including the further step of lowering gates to entrance lanes to the crossing on receiving the train approach signal.

38. The system of claim 8 further including auxiliary sensors for train detection placed adjacent to railroad tracks but outside the protected area of the crossing for determining when a train has entered or left the protected area of the crossing.

39. The system of claim 38 wherein the auxiliary sensors are placed 10 to 20 feet outside of the crossing adjacent to the railroad track where the track enters and leaves the crossing.

* * * * *